US006824074B2

(12) United States Patent
Komornicki

(10) Patent No.: US 6,824,074 B2
(45) Date of Patent: Nov. 30, 2004

(54) AIR ASSISTED SPRAY NOZZLE ASSEMBLY FOR SPRAYING VISCOUS LIQUIDS

(75) Inventor: Waclaw Komornicki, Naperville, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 10/368,943

(22) Filed: Feb. 18, 2003

(65) Prior Publication Data

US 2004/0159720 A1 Aug. 19, 2004

(51) Int. Cl.[7] ..... B05B 1/28

(52) U.S. Cl. ..... 239/290; 239/296; 239/597; 239/601

(58) Field of Search ..... 239/290, 296, 239/299, 418, 424–425, 589, 597–601

(56) References Cited

U.S. PATENT DOCUMENTS 3,561,677 A * 2/1971 Norris et al. ..... 239/705
5,180,104 A * 1/1993 Mellette ..... 239/8
5,249,746 A * 10/1993 Kaneko et al. ..... 239/296
5,344,078 A * 9/1994 Fritz et al. ..... 239/296
5,799,875 A * 9/1998 Weinstein et al. ..... 239/296

* cited by examiner

*Primary Examiner*—Thomas Denion
*Assistant Examiner*—Kyle M. Riddle
(74) *Attorney, Agent, or Firm*—Leydig, Voit & Meyer, Ltd.

(57) ABSTRACT

An external mix air atomizing spray nozzle assembly having a nozzle body formed with liquid and air passages, a spray tip at a downstream end of the nozzle body having a nose portion that defines a liquid discharge orifice, and an air cap mounted in surrounding relation to the spray tip nose portion. The air cap defines an annular pressurized air orifice about the spray tip nose portion and a plurality of angled air passages disposed radially outwardly thereof. Pursuant to the invention, the spray tip nose portion has a frustoconical end tapering inwardly in a downstream direction which enhances air entrainment and minimizes liquid turbulence in a zone immediately in front of the air cap and around the spray tip nose portion to prevent undesirable build up of spray material on the exposed end surfaces of the spray tip nose portion and air cap.

17 Claims, 1 Drawing Sheet

AIR ASSISTED SPRAY NOZZLE ASSEMBLY FOR SPRAYING VISCOUS LIQUIDS

FIELD OF THE INVENTION

The present invention relates generally to spray nozzle assemblies, and more particularly, to external mix air atomizing spray nozzle assemblies in which a discharging liquid flow stream is atomized and formed into the desired spray pattern by pressurized air externally of the liquid discharge orifice.

BACKGROUND OF THE INVENTION

External mix air atomizing spray nozzles are known for their ability to control liquid particle size and spray distribution by pressurized air, substantially independent of liquid flow rate. Such spray nozzle assemblies typically include a liquid spray tip through which the liquid flow stream is directed and an air cap mounted in surrounding relation to the liquid spray tip for directing pressurized air streams that interact with the liquid flow stream discharging from the spray tip to further break down the liquid into particles and to direct the particles into the desired spray pattern. Such air assisted spray nozzles commonly are used in industry for directing highly viscous coatings onto various products.

By virtue of the turbulence that can be created as a result of the intermixing pressurized liquid and air streams discharging from the spray nozzle assembly, randomly directed particles can contact and accumulate on externally exposed faces of the liquid spray tip and air cap, which can quickly impede the discharge of the liquid and air flow streams and prevent the necessary uniform application of the coating materials. In some cases, such accumulations can occur within as short a period as 15 minutes of operation, necessitating frequent shut-down of the production line in order to clean the nozzle assemblies. Repeated interruption in the spray operation significantly affects efficiency of the processing system.

OBJECTS AND SUMMARY OF THE INVENTION

It is an object of the present invention to provide an improved air assisted spray nozzle assembly adapted for more efficiently spraying highly viscous materials.

Another object is to provide a spray nozzle assembly as characterized above which has a design which substantially reduces or eliminates undesirable build up of sprayed material on externally exposed faces of the liquid spray tip and air cap.

A further object is to provide a spray nozzle assembly of the above kind that is relatively simple in construction and which lends itself to economical manufacture and usage.

Still another object is to provide a spray nozzle assembly of such type which can utilize standard conventional air caps.

Other objects and advantages of the invention will become apparent upon reading the following detailed description and upon reference to the drawings, in which:

Figure 1:
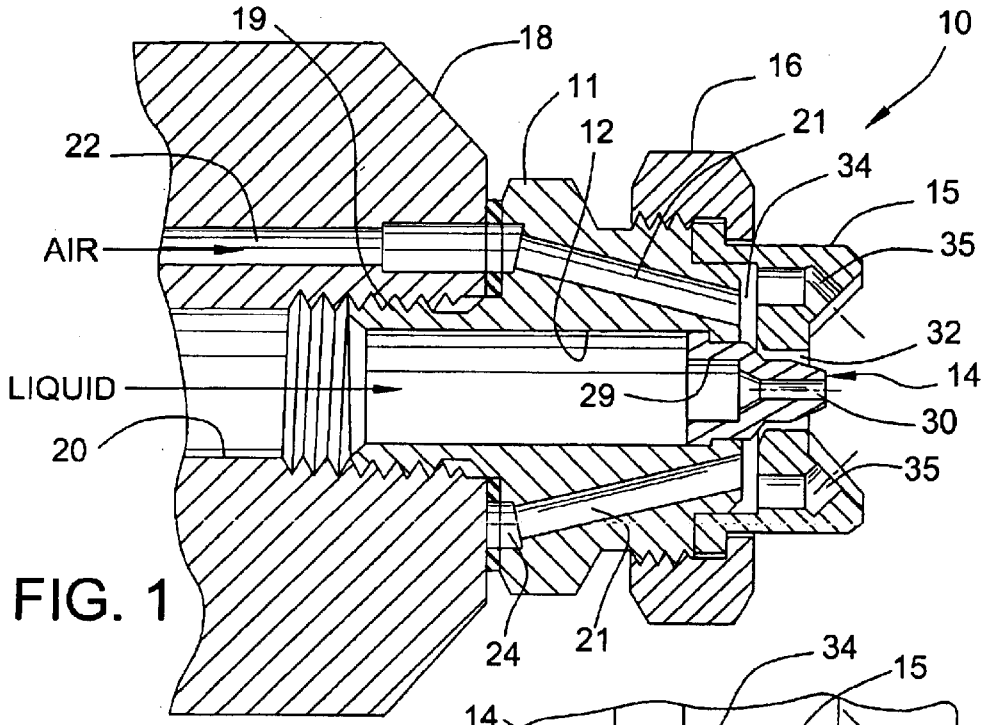
FIG. 1 is a longitudinal fragmentary section of an illustrative external mix spray nozzle assembly in accordance with the invention, taken axially through the spray nozzle assembly.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFFERED EMBODIMENTS

Referring now more particularly to FIG. 1 of the drawings, there is shown an illustrative external mix spray nozzle assembly 10 in accordance with the invention. The spray nozzle assembly 10 includes a nozzle body 11 having a central liquid flow passage 12 with a liquid spray tip 14 at the discharge end thereof and an air cap 15 mounted in surrounding relation to the discharge end of the nozzle body 11 by a retaining ring 16. The nozzle body 11 in this instance is affixed to the forward end of a base portion 18 by a threaded stem 19 with a central liquid passageway 20 of the base portion 18 communicating with the nozzle body passage 12. The nozzle body 11 further is formed with one or more pressurized air passages 21 which extend through the nozzle body 11 and which communicate with an air passage 22 in the base portions 18 through an annular chamber 24 in the upstream end of the nozzle body 11. In a known manner, suitable supply lines can be coupled to the base portion liquid and gas passages 20, 22 for supplying pressurized streams of liquid and air to the nozzle body passages 12, 21, respectively. Alternatively, it will be understood that the base portion 18 could be the body of a liquid spray gun having a reciprocatable valve needle, for controlling the discharging liquid, such as shown in U.S. Pat. No. 5,707,010 assigned to the same assignee as the present application, the disclosure of which is incorporated herein by reference.

The spray tip 14 has a forwardly extending nose portion 26 that extends axially into a central opening 28 of the air cap 15. The spray tip 14 in this case has a central liquid flow passage 29 that communicates with the nozzle body passage 20 and converges in a downstream direction. The spray tip passage 29 includes a smaller diameter, downstream cylindrical passage 27 that defines a liquid discharge orifice 30. The liquid discharge orifice 30 in this case is defined by a sharp downstream annular edge 30*a* of the passage 27 where the cylindrical passage 27 intersects the end face of the nose portion 26. While the nose portion 26 and the liquid discharge orifice 30 in the illustrated embodiment are defined by a separate liquid spray tip insert 14 press fit into the downstream end of the nozzle body passage 12, alternatively the nose portion 26 could be integrally formed with the nozzle body 11.

The air cap 15 may be of a conventional type, such as shown in application Ser. No. 09/892,138, assigned to the same assignee as the present application, the disclosure of which is incorporated by reference. The spray tip nose portion 26 is slightly smaller in diameter than the central air cap opening 28 for defining an annular air atomizing discharge orifice 32 communicating with the nozzle body and base portion air passages 21, 22 through an annular chamber 34 for discharging an annular primary atomizing air stream generally parallel to the liquid stream discharging from the primary liquid discharge orifice 30. The air cap 15 further is formed with a pair of opposed fan air passages 35 communicating with the annular air chamber 34, which in turn communicates with the pressurized air passages 21, 22 for atomizing, forming, and directing the discharging liquid into the desired spray pattern. The fan air passages 35 are oriented at an angle, such as 45°, to the longitudinal axis of the spray nozzle assembly. While the angled fan air passages 35 in this case direct air from diametrically opposed sides of the central discharge orifice 32 for generating a flat spray pattern, it will be understood by one skilled in the art that a greater number of circumferentially spaced angled fan passages could be used for generating a conical spray pattern.

In accordance with the invention, an external downstream end of the liquid spray tip nose portion is beveled or tapered inwardly in a downstream direction for substantially reducing turbulence and undesirable build up of discharging liquid particles on external surfaces of the spray tip and air cap. To this end, in the illustrated embodiment, the spray tip nose portion 26 has a frustoconical downstream end 40 which tapers inwardly in a downstream direction, commencing from a location within the central opening 28 of the air cap 15. The frustoconical end 40 defines an included angle $\alpha$, preferably between about 30 and 50°, and most preferably about 40°. The frustoconical end 40 preferably extends outwardly beyond a central end face 41 of the air cap 15 about 0.040 inch, or a distance corresponding to about the diameter of the liquid discharge orifice 30.

It has been found that the tapered end of the spray tip nose substantially reduces undesirable build up of solids from the discharging spray on externally exposed surfaces of the spray tip nose 26 and air cap 15. At the outset, taper of the spray tip nose portion 26 reduces the frontal surface of the spray tip upon which build up can occur. Moreover, the taper of the spray tip nose portion 26 is believed to provide an improved air entrainment in the zone immediately in front of the air cap and around the protruding fluid tip. The axisymmetrical air flow that leaves the annular orifice 32 is affected and shaped by the frustoconical shape of the tip which starts inside the air orifice zone. The exiting air tends to follow the contour of the nose portion, thus expanding less abruptly away from the flow axis than in the case of the prior external mix designs without such frustoconical spray tip end portion. Moreover, it is believed that the layer of air following the contour of the beveled section (i.e. the primary atomizing air stream) tends to induce a higher volume flow of the surrounding air into the primary air stream. These suspected phenomena are believed to greatly improve the velocity and nature of the air circulation in the vicinity of the spray tip 14 and air cap 15. By eliminating stagnant air or trapped air zones the build up of the solidified material on the outside surfaces is greatly reduced.

Finally, in contrast to prior external mix air assisted spray nozzles, the pressurized air stream interacts with less a pronounced step at the end of the spray tip nose portion. The shearing of the air stream and turbulence of the intermixing liquid and air streams are therefore reduced. From the standpoint of reducing build up, it is beneficial to reduce such turbulence as it is believed to generate low velocity, multidirectional flow airborne liquid particles that can accumulate on the downstream end faces of the spray tip nose portion 26 and air cap 15, which can impair proper spray performance. On the other hand, it has been found that the spray nozzle assembly 10 of the present invention can be operated for long periods without cleaning or maintenance even when spraying highly viscous materials, thereby substantially improving processing efficiency.

Figure 2:
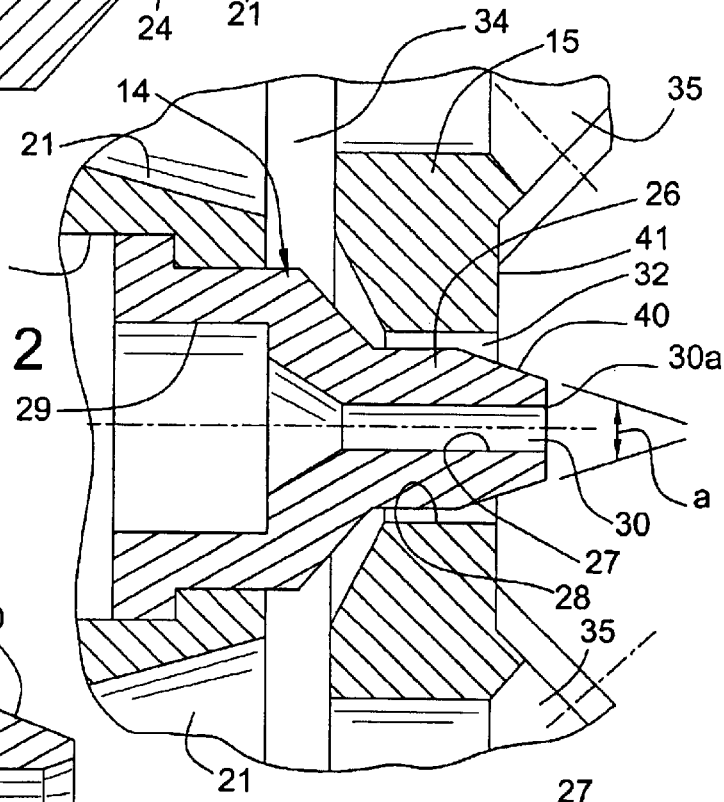
FIG. 2 is an enlarged fragmentary section of the liquid spray tip and air cap of the illustrated spray nozzle assembly.
Figure 3:
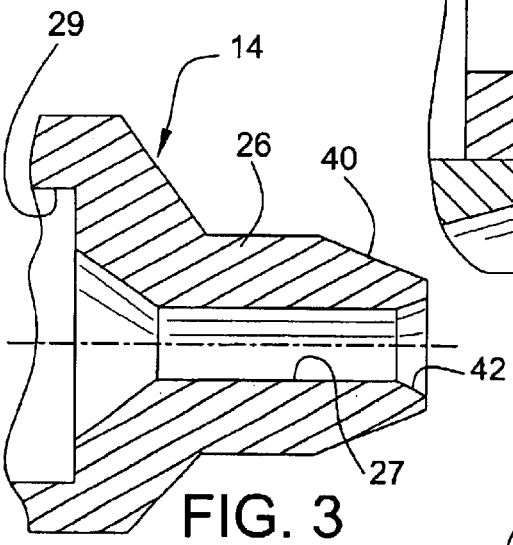
FIG. 3 is an enlarged fragmentary section of a spray tip with an alternative embodiment of liquid spray tip.

Referring now to FIG. 3, there is shown an alternative embodiment of a spray tip according to the invention, which is identical to that shown in FIGS. 1–2, except that the spray tip liquid discharge passageway 27 terminates with a small outwardly directed chamfer 42 at the downstream end. Even with such chamfer 42, which tends to permit the discharging liquid to have a slight outward flare, the enhanced air entrainment and reduced turbulence of the discharging liquid by reason of the tapered external end 40 of the liquid spray tip nose 26 prevents or substantially minimizes build up of solids on the external surfaces of the spray tip and air cap.

Figure 4:
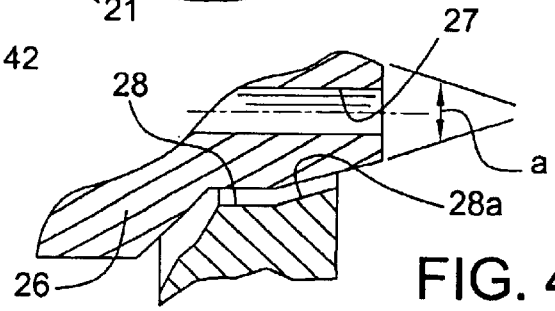
FIG. 4 is an enlarged fragmentary section of a spray nozzle assembly having an alternative form of air cap.

Referring now to FIG. 4, there is shown a spray nozzle assembly similar to that described above with an air cap having an alternatively configured central opening 28. The central opening 28 in this case terminates with an inwardly tapered or conical downstream portion 28*a* parallel to the tapered end of the spray tip nose portion 26. The substantially parallel frustoconical portions 40, 28*a* of the spray tip nose portion 26 and the central air cap opening 28 direct the primary air stream through the annular orifice 32 in a slight inward direction, which further enhances the air entrainment in the zone in front of the air cap and protruding fluid tip for preventing the random direction and build up of liquid particles on the outside surfaces of the spray tip nose portion and air cap.

While the tapered end portion 40 of the spray tip nose portion 26 in the illustrated embodiment has a conical configuration, it will be understood that the nose portion may have other tapered or beveled configurations. For purposes herein, it will be understood that "tapered" nose portion is intended to mean a spray tip nose portion that has a diameter or cross section that reduces in size in a downstream direction, such as the conical shape illustrated, a bullet form, a frustoconical shape with inwardly or outwardly curved sidewalls, or an external end portion defined by a multiplicity of beveled or tapered surfaces extending in a longitudinal inwardly converging downstream direction.

From the foregoing, it can be seen that the spray nozzle assembly of the present invention is adapted for more efficient and effective spraying of highly viscous materials. The spray nozzle assembly substantially eliminates undesirable build up of sprayed material on the externally exposed faces of the liquid spray tip and air cap. Yet, the spray nozzle assembly is relatively simple in construction, lends itself to economical manufacture and usage, and can use conventional air caps.

What is claimed is:

1. An external mix air atomizing spray nozzle assembly comprising a nozzle body having a liquid passage through which a pressurized liquid can be directed, a spray tip nose portion at a downstream end of the nozzle body defining a circular liquid discharge orifice, an air cap mounted in surrounding relation to said spray tip nose portion, said air cap having a central opening in which said spray tip nose portion is disposed, said air cap central opening and spray tip nose portion defining an annular air orifice coaxial with said liquid discharge orifice for communication with a pressurized air source and for directing an annular pressurized air stream for interacting with liquid discharging from said liquid discharge orifice, said spray tip nose portion extending outwardly beyond a central end face of said air cap a distance corresponding to about the diameter of said liquid discharge orifice, said air cap having a plurality of angled air passages disposed radially outwardly of said annular air passage for communication with a pressurized air source and for directing air streams at an angle to the axis of said annular air passage and liquid discharge orifice for further interacting with and controlling the liquid discharge from said liquid discharge orifice, and said spray tip nose portion having a downstream end portion that is inwardly tapered in a downstream direction relative to the axis of said annular air passage and liquid discharge orifice over which pressurized air passes prior to interacting with liquid discharging from said liquid discharge orifice.

2. The spray nozzle assembly of claim 1 in which said tapered nose portion is frustoconical in shape.

3. The spray nozzle assembly of claim 2 in which a taper of said tapered nose portion originates within said central air cap opening.

4. The spray nozzle assembly of claim 1 in which said spray tip nose portion and liquid discharge orifice is defined by and insert fixed within a downstream end of said nozzle body liquid passage with said nose portion projecting in an outwardly extending downstream direction relative to the nozzle body.

5. The spray nozzle assembly of claim 2 in which said frustoconical shaped spray tip end portion defines an included angle of about 30 and 50°.

6. The spray nozzle assembly of claim 5 in which said frustoconical end portion of the spray tip nose portion defines an included angle of about 40°.

7. The spray nozzle assembly of claim 1 in which said nozzle body has at least one pressurized air passage communicating with said annular air passage and said angled air passages.

8. The spray nozzle assembly of claim 1 in which said air cap central opening has a downstream end portion that tapers inwardly in a downstream direction.

9. The spray nozzle assembly of claim 8 in which said central air cap opening end portion and said spray tip end portion are substantially parallel.

10. An external mix air atomizing spray nozzle assembly comprising a nozzle body having a liquid passage through which a pressurized liquid can be directed and at least one pressurized air passage, a spray tip nose portion at a downstream end of the nozzle body defining a circular liquid discharge orifice, an air cap mounted in surrounding relation to said spray tip nose portion, said air cap having a central opening in which said spray tip nose portion is disposed, said air cap central opening and spray tip nose portion defining an annular air orifice coaxial with said liquid discharge orifice communicating with said at least one nozzle body air passage for directing an annular pressurized air stream for interacting with liquid discharging from said liquid discharge orifice, said spray tip nose portion extending outwardly beyond a central end face of said air cap a distance corresponding to about the diameter of said liquid discharge orifice, said air cap having a plurality of angled air passages disposed radially outwardly of said annular air passage communicating with said at least one nozzle body air passage for directing air streams at an angle to said annular air stream and liquid discharging from said liquid discharge orifice for further interacting with and controlling the discharging liquid, and said spray tip nose portion having a frustoconical end portion that tapers inwardly in a downstream direction over which pressurized air passes prior to interacting with liquid discharging from said liquid discharge orifice.

11. The spray nozzle assembly of claim 10 in which a taper of said frustoconical end portion originates within said central air cap opening.

12. The spray nozzle assembly of claim 10 in which said spray tip nose portion has an internal cylindrical downstream passage section, and said liquid discharge orifice is defined by a sharp annular intersecting edge between said internal cylindrical passage section and an end face of said nose portion.

13. The spray nozzle assembly of claim 11 in which said frustoconical end portion of said spray tip nose portion defines and included angle of about 30 and 50°.

14. An external mix air atomizing spray nozzle assembly comprising a nozzle body having a liquid passage through which a pressurized liquid can be directed, a spray tip nose portion at a downstream end of the nozzle body defining a liquid discharge orifice, an air cap mounted in surrounding relation to said spray tip nose portion, said air cap having a central opening in which said spray tip nose portion is disposed, said air cap central opening and spray tip nose portion defining an annular air orifice coaxial with said liquid discharge orifice for communication with a pressurized air source and for directing an annular pressurized air stream for interacting with liquid discharging from said liquid discharge orifice, said air cap having a plurality of angled air passages disposed radially outwardly of said annular air passage for communication with a pressurized air source and for directing air streams at an angle to the axis of said annular air passage and liquid discharge orifice for further interacting with and controlling the liquid discharge from said liquid discharge orifice, said spray tip nose portion having a downstream end portion with a frustoconical shape that tapers inwardly in a downstream direction relative to the axis of said annular air passage and liquid discharge orifice over which pressurized air passes prior to interacting with liquid discharging from said liquid discharge orifice, spray tip nose portion having an internal cylindrical downstream passage section, and said liquid discharge orifice being defined by a sharp annular intersecting edge between said cylindrical passage section and an end face of said nose portion.

15. An external mix air atomizing spray nozzle assembly comprising a nozzle body having a liquid passage through which a pressurized liquid can be directed, a spray tip nose portion at a downstream end of the nozzle body defining a liquid discharge orifice, an air cap mounted in surrounding relation to said spray tip nose portion, said air cap having a central opening in which said spray tip nose portion is disposed, said air cap central opening and spray tip nose portion defining an annular air orifice coaxial with said liquid discharge orifice for communication with a pressurized air source and for directing an annular pressurized air stream for interacting with liquid discharging from said liquid discharge orifice, said air cap having a plurality of angled air passages disposed radially outwardly of said annular air passage for communication with a pressurized air source and for directing air streams at an angle to the axis of said annular air passage and liquid discharge orifice for further interacting with and controlling the liquid discharge from said liquid discharge orifice, said spray tip nose portion having a downstream end portion with a frustoconical shape that tapers inwardly in a downstream direction relative to the axis of said annular air passage and liquid discharge orifice over which pressurized air passes prior to interacting with liquid discharging from said liquid discharge orifice, said spray tip nose portion having an internal cylindrical downstream passage section, and said liquid discharge orifice being defined by an outwardly flared chamfered edge between said cylindrical passage section and a downstream end face of said nose portion.

16. An external mix air atomizing spray nozzle assembly comprising a nozzle body having a liquid passage through which a pressurized liquid can be directed, a spray tip nose portion at a downstream end of the nozzle body defining a liquid discharge orifice, an air cap mounted in surrounding relation to said spray tip nose portion, said air cap having a central opening which includes a cylindrical passage section that intersects an end face of said air can, said spray tip nose portion being disposed in said cylindrical passage section said air cap central opening and spray tip nose portion defining an annular air orifice coaxial with said liquid discharge orifice for communication with a pressurized air source and for directing an annular pressurized air stream for interacting with liquid discharging from said liquid discharge orifice, said air cap having a plurality of angled air passages disposed radially outwardly of said annular air passage for communication with a pressurized air source and for directing air streams at an angle to the axis of said annular air passage and liquid discharge orifice for further interacting with and controlling the liquid discharge from said liquid discharge orifice, and said spray tip nose portion having a cylindrical section within said central cylindrical passage section of said air cap opening and a downstream tapered end section that originates within said cylindrical passage section of said air can central opening and tapers inwardly in a downstream direction relative to the axis of said annular air passage and liquid discharge orifice over which pressurized air passes prior to interacting with liquid discharging from said liquid discharge orifice.

17. The spray nozzle assembly of claim 16 in which said tapered nose section protrudes outwardly beyond a central endface of said air cap.

* * * * *